US010359174B1

(12) United States Patent
Chen

(10) Patent No.: US 10,359,174 B1
(45) Date of Patent: Jul. 23, 2019

(54) MULTIPLE LIGHT DISTRIBUTION STRUCTURE OF DIRECTIONAL LIGHT SOURCE

(71) Applicant: NINGBO YAMAO OPTOELECTRONICS CO., LTD., Xikou Ningbo (CN)

(72) Inventor: Hui Chen, Xikou Ningbo (CN)

(73) Assignee: Ningbo Yamao Optoelectronics Co., Ltd., Xikou Ningbo, Zhejian (CN)

( * ) Notice: Subject to any disclaimer, the term of this patent is extended or adjusted under 35 U.S.C. 154(b) by 0 days.

(21) Appl. No.: 16/130,085

(22) Filed: Sep. 13, 2018

(30) Foreign Application Priority Data

Apr. 11, 2018 (CN) ..... 2018 2 0510266 U

(51) Int. Cl.

| | |
|---|---|
| ***F21V 1/00*** | (2006.01) |
| ***F21V 3/02*** | (2006.01) |
| ***F21K 9/66*** | (2016.01) |
| ***F21K 9/235*** | (2016.01) |
| ***F21K 9/69*** | (2016.01) |
| ***F21V 7/06*** | (2006.01) |
| ***F21K 9/68*** | (2016.01) |

(52) U.S. Cl.
CPC ..... *F21V 3/02* (2013.01); *F21K 9/235* (2016.08); *F21K 9/66* (2016.08); *F21K 9/68* (2016.08); *F21K 9/69* (2016.08); *F21V 7/06* (2013.01)

(58) Field of Classification Search
None
See application file for complete search history.

(56) References Cited

U.S. PATENT DOCUMENTS

2015/0369450 A1* 12/2015 Johnson ..... G02B 3/08 362/294

* cited by examiner

*Primary Examiner* — Vip Patel
(74) *Attorney, Agent, or Firm* — The Myers Law Group

(57) ABSTRACT

The present invention discloses a multiple light distribution structure of a directional light source, which comprises a reflective cup having a bowl shape, an inner wall of the reflective cup being coated with a reflective layer; a light source plate disposed inside the reflective cup, the light source plate being fixed to a bottom of the reflective cup by means of a plurality of screws, and the light source plate having a plurality of light emitting units which are provided thereon; a lens facing the light source plate, the lens having a plurality of lens units which are provided thereon, each of the plurality of lens units facing one of the plurality of light emitting units; and a multi-point lens, covering on the reflective cup. Owning to multiple light distributions performed through the reflective cup, the lens and the multi-point lens, light in the beam angle may be evenly distributed.

13 Claims, 3 Drawing Sheets

MULTIPLE LIGHT DISTRIBUTION STRUCTURE OF DIRECTIONAL LIGHT SOURCE

PRIORITY CLAIM

This application claims the priority date of China application no. 201820510266.4 filed Apr. 11, 2018, which is herein incorporated by reference in its entirety.

BACKGROUND

The invention relates to the technical field of a directional light source, and more particularly, to a light distribution structure of the directional light source.

Generally, after a directional light source of an LED is distributed, light in its beam angle is unevenly distributed. In particular, it is observed that the central light intensity is high, and a stepped drop is presented. In addition, yellow spots and black dots can be found on the illuminated object, and stray light is emitted outside the beam angle.

When replacing the traditional light source, the directional light source must be matched to the light distribution curve of the original product, thus, requirements for light environment can be met.

SUMMARY

Given that the foregoing problems exist in the prior art, the present invention provides a multiple light distribution structure of a directional light source.

In order to achieve the above purposes, the present invention adopts the following technical solutions.

A multiple light distribution structure of a directional light source comprises a reflective cup having a bowl shape, an inner wall of the reflective cup being coated with a reflective layer; a light source plate disposed inside the reflective cup, the light source plate being fixed to a bottom of the reflective cup by means of a plurality of screws, and a plurality of light emitting units are provided on the light source plate; a lens facing the light source plate, and a plurality of lens units are provided on the lens, each of the plurality of lens units facing one of the plurality of light emitting units; and a multi-point lens, covering on the reflective cup.

The above-mentioned multiple light distribution structure of the directional light source further comprises a lamp cup, wherein the reflective cup, the light source plate and the lens are disposed inside the lamp cup, an outer wall of the reflective cup fits into an inner wall of the lamp cup, and the multi-point lens is fixedly connected to an outer edge of one end of the lamp cup; a lamp cap, disposed at the other end of the lamp cup relative to the multi-point lens; and a power source, disposed inside the lamp cup and located between the reflective cup and the lamp cap, the power source being electrically connected to the light source plate.

In the above-mentioned multiple light distribution structure of the directional light source, the lens is an integrated structure, and the lens comprises a lens board and a plurality of lens units connected to the lens board.

In the above-mentioned multiple light distribution structure of the directional light source, each of the plurality of lens units has a truncated cone shape, and one end of each of the plurality of lens units, located adjacent to the lens board, has a diameter larger than that of the other end of each of the plurality of lens units.

In the above-mentioned multiple light distribution structure of the directional light source, the other end of each of the plurality of lens units forms a convex arc surface, and each of the convex arc surfaces faces each of the plurality of light emitting units.

In the above-mentioned multiple light distribution structure of the directional light source, one side of the multi-point lens facing the light source plate is a bead surface, and the other side of the multi-point lens facing away from the light source plate is a smooth surface.

In the above-mentioned multiple light distribution structure of the directional light source, one end of the power source is connected to the lamp cap, and the other end of the power source passes through the reflective cup and is connected to the light source plate.

In the above-mentioned multiple light distribution structure of the directional light source, the lamp cap is an aluminum and nickel plating lamp cap.

In the above-mentioned multiple light distribution structure of the directional light source, each of the plurality of screws is self-tapping screw.

By adopting the aforementioned technical solutions, the present invention has the following advantageous effects when compared with the prior art, that is, owning to multiple light distributions performed through the reflective cup, the lens and the multi-point lens, light in the beam angle may be evenly distributed.

BRIEF DESCRIPTION OF THE DRAWINGS

The accompanying drawings, together with the specification, illustrate exemplary embodiments of the present disclosure, and, together with the description, serve to explain the principles of the present invention.

LIST OF REFERENCE NUMERALS

Figure 1:
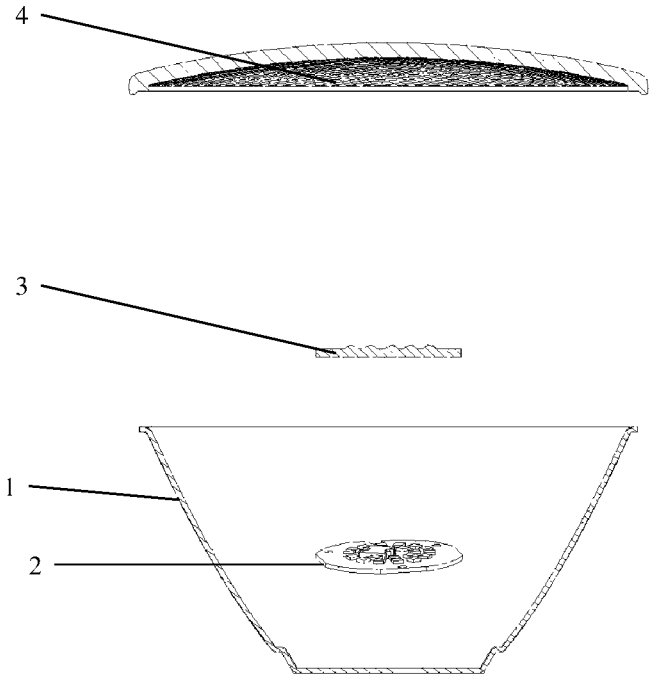
FIG. 1 is a schematic view of light distribution of a multiple light distribution structure of a directional light source according to the present invention.

1. Reflective cup
2. Light source plate
21. Screw
3. Lens
31. Lens unit
32. Lens board
4. Multi-point lens
5. Lamp cup
6. Lamp cap
7. Power source

DETAILED DESCRIPTION

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, the term "plurality" means a number greater than one.

Hereinafter, certain exemplary embodiments according to the present disclosure will be described with reference to the accompanying drawings.

Figure 2:
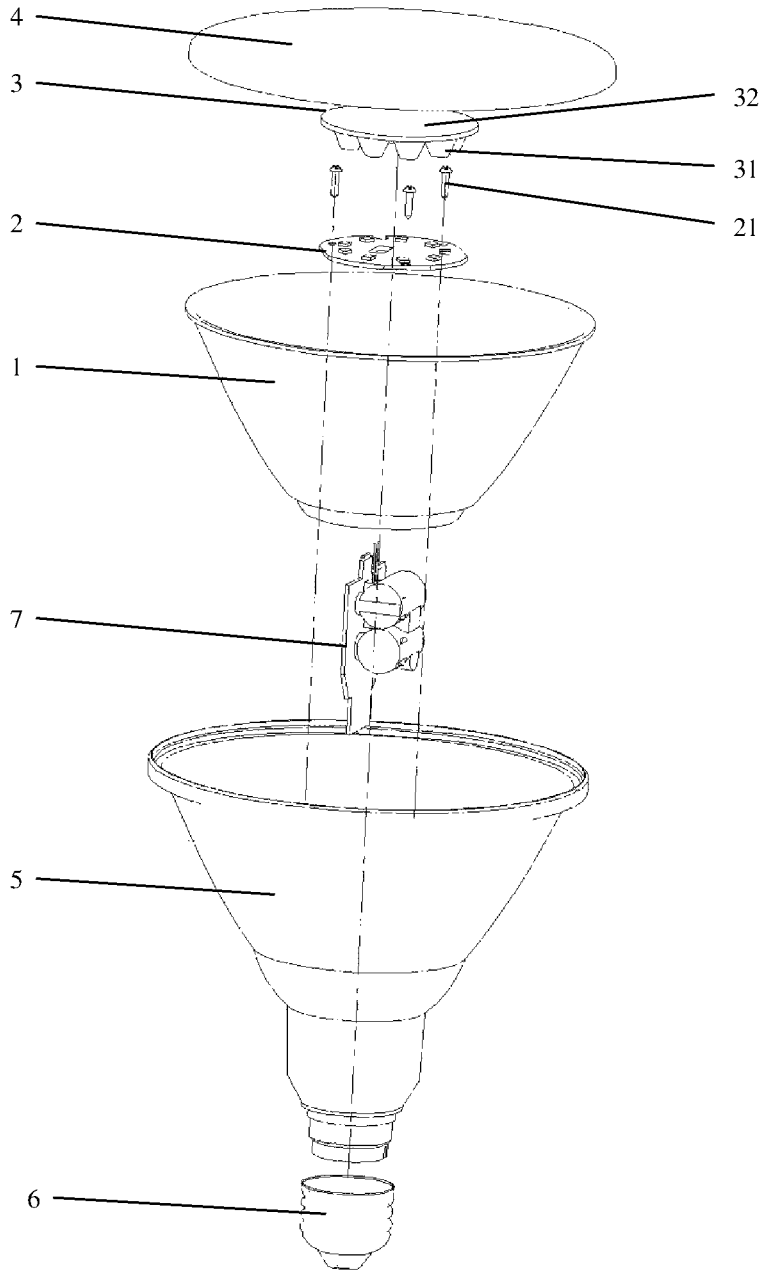
FIG. 2 is a schematic view of structure of a multiple light distribution structure of a directional light source according to the present invention.
Figure 3:
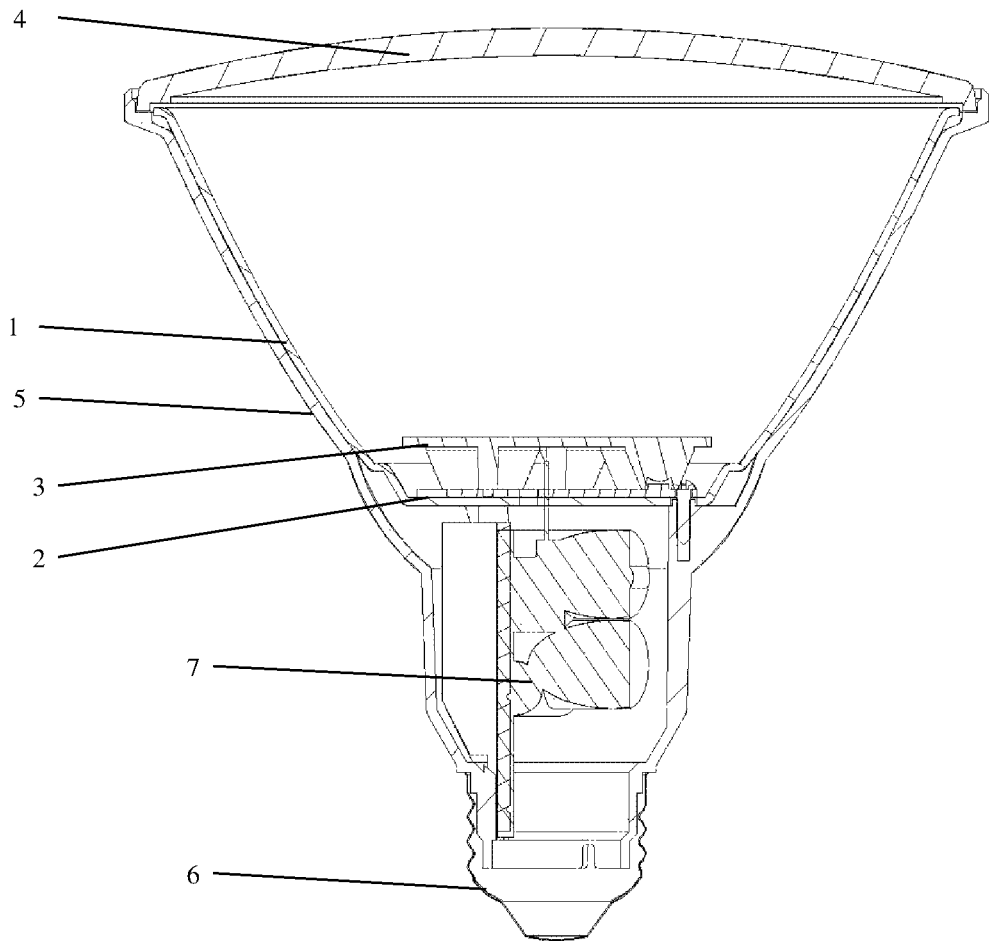
FIG. 3 is a cross-sectional view of a multiple light distribution structure of a directional light source according to the present invention.

FIG. 1 is a schematic view of light distribution of a multiple light distribution structure of a directional light source according to the present invention, FIG. 2 is a schematic view of structure of a multiple light distribution structure of a directional light source according to the present invention, and FIG. 3 is a cross-sectional view of a multiple light distribution structure of a directional light source according to the present invention. Referring now to FIGS. 1-3, a multiple light distribution structure of a directional light source in a preferred embodiment is shown, and the multiple light distribution structure of the directional light source comprises a reflective cup 1 having a bowl shape, and an inner wall of the reflective cup 1 is coated with a reflective layer. The first light distribution is performed through the reflective cup 1.

In addition, the multiple light distribution structure of the directional light source in a preferred embodiment further comprises a light source plate 2 disposed inside the reflective cup 1, wherein the light source plate 2 is fixed to a bottom of the reflective cup 1 by means of a plurality of screws 21, and the light source plate 2 has a plurality of light emitting units which are provided thereon. Light is provided through the reflection of the light source plate 2 by the reflective cup 1.

In addition, the multiple light distribution structure of the directional light source in a preferred embodiment further comprises a lens 3 facing the light source plate 2. The lens 3 has a plurality of lens units 31 which are provided thereon, each lens unit 31 facing one of the plurality of light emitting units. A second light distribution is performed through the lens 3. After being distributed by the reflective cup 1, the light source plate 2 readjusts light using the lens 3, and the light is evenly emitted onto the illuminated object.

Furthermore, the multiple light distribution structure of the directional light source in a preferred embodiment further comprises a multi-point lens 4, covering on the reflective cup 1. The third light distribution is performed through the multi-point lens 4. Light emitted from the plurality of light emitting units is evenly distributed in the effective beam angle after passing though the reflective cup 1, the lens 3 and the multi-point lens 4.

Furthermore, the multiple light distribution structure of the directional light source in a preferred embodiment further comprises a lamp cup 5, wherein the reflective cup 1, the light source plate 2 and the lens 3 are disposed inside the lamp cup 5, an outer wall of the reflective cup 1 fits into an inner wall of the lamp cup 5, and the multi-point lens 4 is fixedly connected to an outer edge of one end of the lamp cup 5.

Furthermore, the multiple light distribution structure of the directional light source in a preferred embodiment further comprises a lamp cap 6, disposed at the other end of the lamp cup 5 relative to the multi-point lens 4.

On the other hand, the multiple light distribution structure of the directional light source in a preferred embodiment further comprises a power source 7. The power source 7 is disposed inside the lamp cup 5 and located between the reflective cup 1 and the lamp cap 6, and the power source 7 is electrically connected to the light source plate 2. The light source plate 2 is powered by the power source 7.

The foregoing description is only a preferred embodiment of the present invention, not thus limiting the embodiments and scope of the invention.

The invention further has the following implementation based on the above-mentioned embodiment. Specifically, in a further embodiment of the invention, referring again to FIGS. 1-3, the lens 3 is an integrated structure and is made of a lens material. In addition, the lens 3 comprises a lens board 32 and a plurality of lens units 31 connected to the lens board 32.

In a preferred embodiment of the invention, the lens board 32 is a circular plate. Each of the plurality of lens units 31 has a truncated cone shape, and one end of each of the plurality of lens units 31, located adjacent to the lens board 32, has a diameter larger than that of the other end of each of the plurality of lens units 31.

In a preferred embodiment of the invention, the other end of each of the plurality of lens units 31 forms a convex arc surface, and each of the plurality of convex arc surfaces faces one of the plurality of light emitting units.

In a preferred embodiment of the invention, one side of the multi-point lens 4 facing the light source plate 2 is a bead surface, and the other side of the multi-point lens 4 facing away from the light source plate 2 is a smooth surface. Specifically, the multi-point lens 4 has an arc surface structure, the concave arc surface of the multi-point lens 4 faces the light source plate 2, and the convex arc surface of the multi-point lens 4 faces away from the light source plate 2.

In a preferred embodiment of the invention, one end of the power source 7 is connected to the lamp cap 6, and the other end of the power source 7 passes through the reflective cup 1 and is connected to the light source plate 2.

In a preferred embodiment of the invention, the lamp cap 7 is an aluminum and nickel plating lamp cap.

In a preferred embodiment of the invention, each of the plurality of screws 21 is self-tapping screw.

Various aspects of the present invention are described herein with reference to illustrations and/or diagrams according to embodiments of the invention. While particular forms of the invention have been illustrated and described, it will also be apparent to those skilled in the art that various modifications can be made without departing from the spirit and scope of the invention. Accordingly, it is not intended that the invention be limited except by the claims.

The invention claimed is:

1. A multiple light distribution structure of a directional light source, comprising:

a reflective cup having a bowl shape, an inner wall of the reflective cup being coated with a reflective layer;

a light source plate disposed inside the reflective cup, the light source plate being fixed to a bottom of the reflective cup by means of a plurality of screws, and a plurality of light emitting units are provided on the light source plate;

a lens facing the light source plate, and a plurality of lens units are provided on the lens, each of the plurality of lens units facing one of the plurality of light emitting units; and a multi-point lens, covering on the reflective cup.

2. The multiple light distribution structure of the directional light source as claimed in claim 1, further comprising:

a lamp cup, wherein the reflective cup, the light source plate and the lens are disposed inside the lamp cup, an outer wall of the reflective cup fits into an inner wall of the lamp cup, and the multi-point lens is fixedly connected to an outer edge of one end of the lamp cup;

a lamp cap, disposed at the other end of the lamp cup relative to the multi-point lens; and a power source, disposed inside the lamp cup and located between the reflective cup and the lamp cap, the power source being electrically connected to the light source plate.

3. The multiple light distribution structure of the directional light source as claimed in claim 1, wherein the lens is an integrated structure, and the lens comprises a lens board and a plurality of lens units connected to the lens board.

4. The multiple light distribution structure of the directional light source as claimed in claim 2, wherein the lens is an integrated structure, and the lens comprises a lens board and a plurality of lens units connected to the lens board.

5. The multiple light distribution structure of the directional light source as claimed in claim 3, wherein each of the plurality of lens units has a truncated cone shape, and one end of each of the plurality of lens units, located adjacent to the lens board, has a diameter larger than that of the other end of each of the plurality of lens units.

6. The multiple light distribution structure of the directional light source as claimed in claim 4, wherein each of the plurality of lens units has a truncated cone shape, and one end of each of the plurality of lens units, located adjacent to the lens board, has a diameter larger than that of the other end of each of the plurality of lens units.

7. The multiple light distribution structure of the directional light source as claimed in claim 5, wherein the other end of each of the plurality of lens units forms a convex arc surface, and each of the convex arc surfaces faces each of the plurality of light emitting units.

8. The multiple light distribution structure of the directional light source as claimed in claim 6, wherein the other end of each of the plurality of lens units forms a convex arc surface, and each of the convex arc surfaces faces each of the plurality of light emitting units.

9. The multiple light distribution structure of the directional light source as claimed in claim 1, wherein one side of the multi-point lens facing the light source plate is a bead surface, and the other side of the multi-point lens facing away from the light source plate is a smooth surface.

10. The multiple light distribution structure of the directional light source as claimed in claim 2, wherein one side of the multi-point lens facing the light source plate is a bead surface, and the other side of the multi-point lens facing away from the light source plate is a smooth surface.

11. The multiple light distribution structure of the directional light source as claimed in claim 2, wherein one end of the power source is connected to the lamp cap, and the other end of the power source passes through the reflective cup and is connected to the light source plate.

12. The multiple light distribution structure of the directional light source as claimed in claim 2, wherein the lamp cap is an aluminum and nickel plating lamp cap.

13. The multiple light distribution structure of the directional light source as claimed in claim 1, wherein each of the plurality of screws is self-tapping screw.

* * * * *